United States Patent [19]

Ingrain

[11] Patent Number: 4,763,096

[45] Date of Patent: Aug. 9, 1988

[54] DEVICE FOR ADJUSTING THE THERMAL CURRENT OF A THERMAL BIMETALLIC STRIP TRIP AND A PROTECTION SWITCH INCLUDING SUCH A DEVICE

[75] Inventor: Raymond Ingrain, Quetigny, France

[73] Assignee: La Telemecanique Electrique, France

[21] Appl. No.: 86,340

[22] Filed: Aug. 14, 1987

[30] Foreign Application Priority Data

Aug. 14, 1986 [FR] France ..... 86 11738

[51] Int. Cl.[4] ..... H01H 71/16

[52] U.S. Cl. ..... 337/82; 335/42; 335/45

[58] Field of Search ..... 337/82; 335/45, 42

[56] References Cited

U.S. PATENT DOCUMENTS 4,023,132 5/1977 Kidd et al. ..... 337/82

*Primary Examiner*—H. Broome

*Attorney, Agent, or Firm*—William A. Drucker

[57] ABSTRACT

A device is provided for adjusting the thermal current of a bimetallic strip thermal tripping device and a protection switch including such a device, said adjustment device including a graduated wheel accessible from outside the switch box and having inner toothing; a flange centered on the wheel, with a member meshing with the toothing of the wheel, and formed with an excentric groove; a tumbler rotated through a finger engaged in the groove of the flange; a hook mounted for pivoting about a pin fixed with respect to the case; and a lever mounted for pivoting by means of a pin on the hook and connected to the tumbler by a stud, the lever being positionable with respect to the bimetallic strip at a given distance depending on the value of the thermal tripping current.

4 Claims, 5 Drawing Sheets

DEVICE FOR ADJUSTING THE THERMAL CURRENT OF A THERMAL BIMETALLIC STRIP TRIP AND A PROTECTION SWITCH INCLUDING SUCH A DEVICE

BACKGROUND OF THE INVENTION

1. Field of the Invention

The present invention relates to a protection switch of the circuit breaker kind having in an isolating case a thermal bimetallic strip tripping device, and it relates more particularly to a device for adjusting the value of the thermal current which causes tripping of the circuit breaker should an electric overload occur, that is to say on the passage of a current exceeding the nominal value of the circuit breaker.

2. Description of the Prior Art

From the patent application FR 2 585 180 a mechanism is already known for adjusting, not only in the factory but also by the user, the thermal tripping current of a circuit breaker through the action of a bimetallic strip. This adjustment mechanism includes:

a wheel accessible from outside the circuit breaker case and having inner toothing, the wheel carrying graduations which correspond to direct or relative current values and which may be brought, by rotating the wheel, opposite an index carried by the case;

an inner flange centered on the wheel, adapted to be driven in rotation, having a member meshing with the teeth of the wheel, and formed with a groove of excentric shape with respect to the axis of rotation of the wheel;

a piece forming a tumbler mounted in the case and rotatable about an axis perpendicular to the axis of rotation of the wheel through a drive member engaged in the groove of the flange, the axis of rotation of the tumbler being fixed with respect to the case.

In the above mentioned application, the tumbler has a pivoting hook with axis parallel to the axis of rotation of the tumbler, which hook has a head cooperating with a nose piece provided at the end of an auxiliary tripping lever and a tail end spaced apart from the bimetallic strip by a given distance depending on the chosen value of the thermal current. Should an electric overload occur, the bimetallic strip urges the hook and forces it to pivot so as to free it from the nose piece of the tripping lever, which pivots so as to cause tripping of the circuit breaker.

For adjusting the thermal tripping current of the circuit breaker in the factory using the above described mechanism, the wheel is first of all locked in a position indexing its corresponding graduation to the minimum value of the thermal current, and the circuit breaker is placed in the set position in which the head of the hook is engaged with the nose piece of the tripping lever. From these initial positions, the flange only is rotated in a suitable direction so as to cause rotation of the tumbler-hook assembly, through the drive member engaged in the groove of the flange, until the tail end of the hook comes into contact with the bimetallic strip. Then, rotation of the flange in the same direction as before causes the hook to pivot about its bearing point on the bimetallic strip, so that the head of the hook is freed from the nose piece of the lever, thus causing tripping of the circuit breaker. The position of the flange which has just caused tripping of the circuit breaker defines a so called zero reference position from which the flange is then rotated in the opposite direction through a predetermined angle so as to move the tail end of the hook over a predefined distance corresponding to the travel of the bimetallic strip for the graduation corresponding to the minimum value of the thermal current initially indexed with the wheel locked. The factory adjustment is then finished and the wheel is then released and interlocked with the flange through the engagement member.

However, the use of this adjustment procedure has a major drawback. In fact, since the pivoting hook is carried by the adjustment tumbler, this latter may occupy initially with respect to the nose piece of the tripping lever a position which is different from one circuit breaker to another in the set position; under these conditions, during adjustment in the factory, the force exerted by the bimetallic strip on the hook for freeing this latter from the nose piece of the lever so as to cause tripping of the circuit breaker, varies depending on the initial position taken by the hook, which inevitably leads to a certain inaccuracy in the final adjustment.

SUMMARY OF THE INVENTION

The purpose of the present invention is then to overcome this drawback and to improve this type of adjustment mechanism used not only in the factory but also by the user, keeping a simplicity in design while making it compact.

For this, the master idea of the invention consists in separating the hook from the adjustment tumbler so as then to maintain the hook in a pseudo fixed position during adjustment in the factory, and providing an appropriate kinematic connnection between the different parts used so as to ensure pivoting the hook during adjustment in the factory, while exerting the same force for causing tripping of the circuit breaker.

Thus, in accordance with the invention, a device for adjusting the thermal current of the above described type, in which the hook is mounted for pivoting about an axis parallel to the axis of rotation of the tumbler, also includes a lever which is pivotally mounted on the hook at its median part by means of a pin so as to form a broken link therewith, and which cooperates at a first end with the tumbler through a connection piece, the lever having a second free end intended to be situated with respect to the thermal bimetallic strip tripping device at a distance depending on the chosen value of the thermal current.

The invention also relates to a protection switch of the circuit breaker type including such a device for adjusting the thermal current, tripping of the circuit breaker being achieved by means of the bimetallic strip, once adjusted via a lock, following an electric overload.

BRIEF DESCRIPTION OF THE DRAWINGS

Other features and advantages of the invention will be better understood from the following detailed description with reference to the accompanying drawings given solely by way of example and in which.

DESCRIPTION OF THE PREFERRED EMBODIMENT

Figure 1:
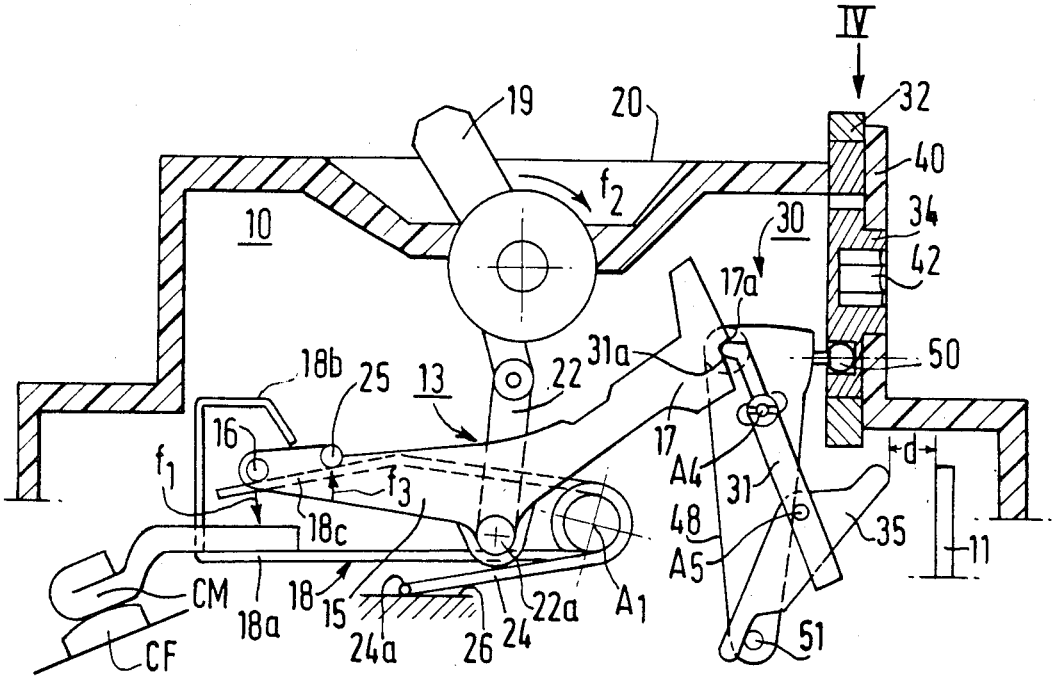
FIGS. 1 and 2 show schematically, in elevation, a part of a circuit breaker in the set position and respectively in the tripped position in the case of an electric overload, with its device for adjusting the thermal current in accordance with the invention.
Figure 2:
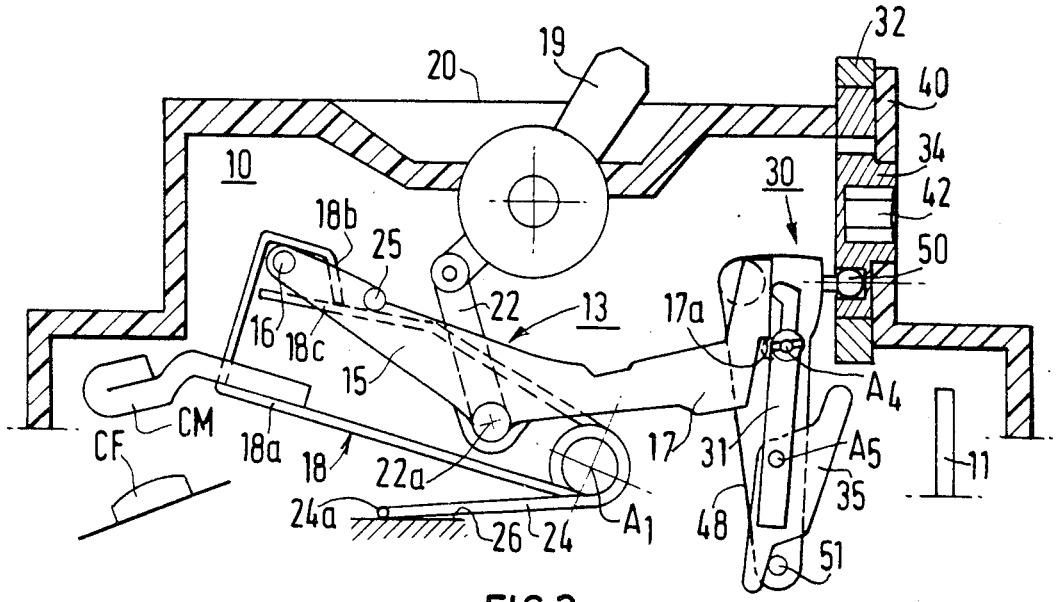

The protection switch illustrated partially in FIGS. 1 and 2 is a modular circuit breaker with insulating case 10 equipped with a device for adjusting the thermal tripping current, designated generally by the reference 30.

The circuit breaker has a pair of separable contacts, namely a fixed contact CF and a mobile contact CM disposed in a current path provided between two terminals (not shown) of the case.

Case 10 includes a thermal bimetallic strip tripping device 11 capable of actuating a lock 13 through a broken link formed of a hook 31 and a lever 35 pivotally connected together so as to separate the mobile contact CM from the fixed contact CF following an electric overload appearing at the downstream terminals of the case.

For the sake of simplicity, the electromagnetic tripping device has not been shown which is housed in the case of the circuit breaker and is also capable of actuating the lock for separating the mobile contact from the fixed contact, following a fault such as a short circuit.

Lock 13 includes a lever 15 in the form of a cradle having two parallel longitudinal arms connected transversally to each other, at one end by a swivel 16 and, at a second end by means of a so called tripping piece 17 having a nose 17*a* in which an end of hook 31 engages when the circuit breaker is in the set position (FIG. 1).

A piece 18 for supporting the mobile contact CM is mounted on a fixed pin $A_1$ and is formed, on, the one hand, by a rigid sole piece 18*a* carrying the mobile contact and ending in a rigid bent leg 18*b* and, on the other hand, by a resilient leg forming a spring 18*c* capable of abutting against the end of leg 18*b*. Swivel 16 of lever 15 bears on the spring leg 18*c* and exerts thereon a downward force $f_1$ when the circuit breaker is in the set position (FIG. 1).

A so called voluntary tripping member such for example as a pivoting handle 19 is associated with the front face 20 of the case 10 of the circuit breaker and is urged in a conventional way by a spring which causes it to pivot in the direction of arrow $f_2$ (FIG. 1).

Handle 19 is connected to lever 15 through a toggle connection 22 which ends in a bearing surface 22*a* fixed to the lever and is capable of sliding in a guide slot (not shown) formed in case 10.

Lever 15 is further urged by a hairpin spring 24 mounted on the fixed pin $A_1$ and the two free ends of which (not shown) come respectively into abutment on the bottom of two stops, only one of which is visible at 25 in FIGS. 1 and 2, mounted respectively transversely on the two arms of the lever; these spring ends are capable of exerting a rising force $f_3$ (FIG. 1) on the stops of lever 15. In addition, spring 24 has a transversely bent leg 24*a* resting on a stop 26 provided in case 10.

The circuit breaker shown in FIGS. 1 and 2, equipped with its thermal current adjustment device, operates in the following way considering the case where the thermal tripping current has already been adjusted by means of said device.

In the set position shown in FIG. 1, handle 19 occupies the left hand position in this FIG. and the mobile contact CM is applied against the fixed contact CF under the effect of the force produced by swivel 16, in the direction of arrow $f_1$, on the spring leg 18*c* of the support piece 18. In addition, the head of hook 31 is engaged in the nose piece 17*a* of the tripping piece 17, whereas lever 35 is disposed with respect to the bimetallic strip 11 at a given distance d which is defined, as is well known, as a function of the chosen value of the thermal tripping current.

When an electric overload appears at the downstream terminals of the case of the circuit breaker, the bimetallic strip 11 is heated by the overload current and undergoes a deflection of amplitude d towards lever 35 of the broken link so as to push said lever which pivots in an anticlockwise direction and drives hook 31; this latter pivots in a clockwise direction and frees itself from the nose of the tripping piece 17 (FIG. 2). Once hook 31 is disengaged from piece 17, and under the effect of the combined forces $f_3$ and of the reaction to $f_1$ (FIG. 1), lever 15 pivots in a clockwise direction about the bearing surface 22*a* of the toggle mechanism 22; swivel 16 of lever 15 pivots then in the same direction, which results in relaxing the spring leg 18*c* which comes into abutment against the end of leg 18*b* of the contact carrying piece 18 (FIG. 2). Then, the reaction to $f_1$ of the spring leg 18*c* is cancelled out, only force $f_3$ contributing to pivoting of lever 15. By pivoting, the swivel 16 of lever 15 comes then into abutment against leg 18*b* and then causes the contact carrying piece 18 to pivot in a clockwise direction about its pin $A_1$, which results in separating the mobile contact CM from the fixed contact CF.

It will be noted that during pivoting of lever 15, the bearing surface 22*a* of the toggle moves in the slot formed in the case and, under the effect of its own assistance spring, the handle 19 pivots from left to right in the direction shown by arrow $f_2$ in FIG. 1; the toggle joint 22 then causes lifting of lever 15, the swivel 16 of this latter, on opening of the mobile contact, sliding over the bent bottom of leg 18*b* of the contact carrying piece 18 (FIG. 2).

The structure properly speaking of the thermal current adjustment device 30 will now be described in detail, with reference to FIGS. 3 and 4.

Figure 3:
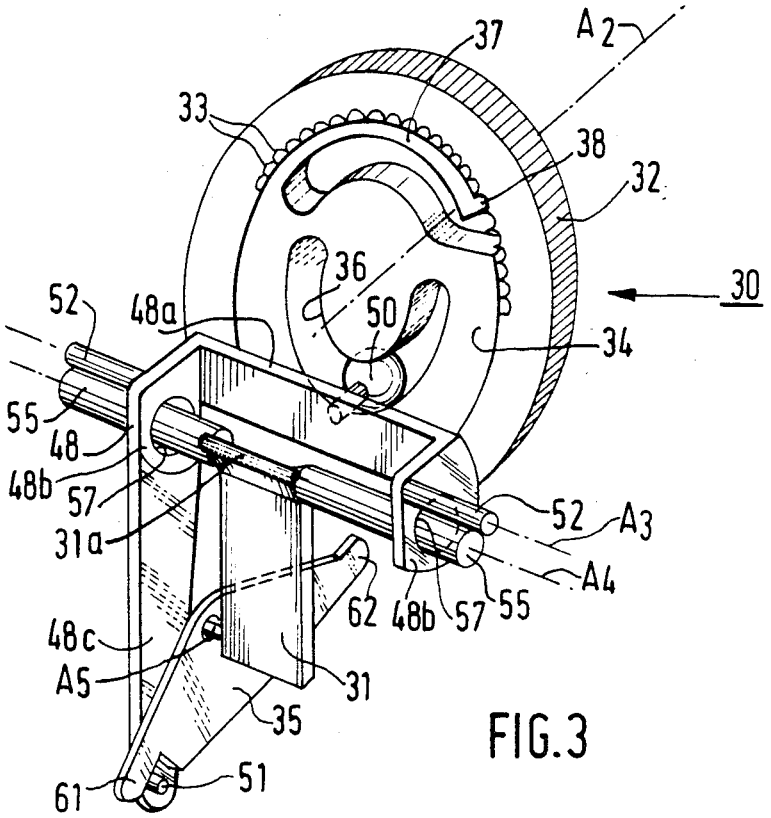
FIG. 3 shows in perspective the thermal current adjustment device in its position illustrated in FIG. 1.

In FIG. 3, the adjustment device 30 includes first of all an insulating wheel 32 in the form of a ring provided with inner teeth 33, and an insulating flange 34, generally of a circular shape, mounted inside the wheel and coaxial therewith.

Flange 34 is formed with a groove 36 of excentric shape with respect to its axis $A_2$ and is recessed so as to form at its periphery an arm 37 ending in a finger 38 meshing with the teeth 33 of the wheel. The section of arm 37 is determined so as to offer sufficient elasticity while keeping a certain stiffness required for rotating the flange by means of the wheel during the so called user adjustment which will be explained further on.

It will be noted that the toothed wheel as well as the grooved recessed flange are both advantageously integrally molded from a plastic material of polyamide type for example; furthermore, the teeth of the wheel may be formed either over the whole inner periphery of the wheel, or preferably only over a part thereof.

As shown in FIGS. 1 and 2, the wheel 32–flange 34 assembly is disposed at the level of a lateral face 40 of case 10, on the bimetallic strip 11 side, while being centered in a bore formed in this face of the case. On the other hand, FIGS. 1 and 2, it can be seen that flange 34 is formed centrally with a blind hole 42 accessible from outside the case for introducing therein a tool such for example as a screwdriver.

Figure 4:
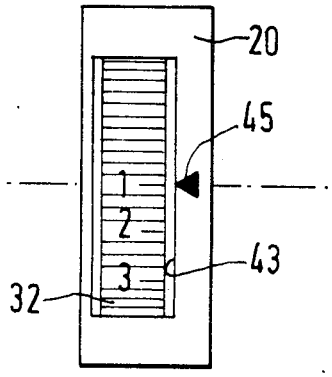
FIG. 4 shows a view in the direction of arrow IV of FIG. 1.

FIG. 4 shows the part of wheel 32 which is accessible from outside the case, by projecting through a rectangular aperture 43 formed in the front face 20 of the case. In this FIG. 4, wheel 32 has a set of graduations which correspond to relative values of the thermal current and which may be brought successively, by rotating the wheel, opposite an index 45 carried by the front face of the case of the circuit breaker.

It should be noted that the wheel may also be graduated in direct values of the thermal current.

As shown in FIG. 3, the adjustment device 30 also includes a part forming a tubular 48 able to be driven in rotation about an axis $A_3$ perpendicular to the axis of rotation $A_2$ of wheel 32, through a drive member formed by a spherical finger 50 engaged in groove 36 of flange 34.

Tumbler 48 has a general U shape whose bottom **48*a* carries the drive finger 50 and one of the two side walls 48*b* of which is extended by a vertical lug 48*c* having, near its free end, a transversely projecting stud 51 serving as retainer for lever 35; the tumbler 48 has, on its two external side walls, two identical coaxially aligned swivels 52** with axis $A_3$ fixed with respect to the case.

Hook 31 is mounted for pivoting on a pin $A_4$ fixed with respect to the case and is pivotally mounted to lever 35 by means of a pin $A_5$. In the embodiment illustrated in FIG. 3, hook 31 is in the form of a plate suspended inside the U shaped tumbler between two coaxially aligned identical transverse swivels 55, with fixed axis $A_4$ parallel to the axis of rotation $A_3$ of the tumbler 48 and mounted for pivoting in the case while freely passing through, that is to say without play, two coaxial orifices 57 formed respectively in the two side walls **48*b* of tumbler 48**.

Hook 31 has a head **31*a* of a generally rounded shape which is intended to engage in the nose 17*a* of the tripping piece 17 (FIG. 1), the center of the rounded head of the hook being then placed by construction on the rotational axis $A_3$ of the tumbler 48**.

As shown in FIG. 3, lever 35 has a general flat and elongate shape whose median part is articulated to hook 31 and whose two opposite ends are formed respectively by two fingers 61, 62 extending in a direction transversal to the pivoting axis $A_5$ and being situated on each side of this axis. Finger 61 rests on stud 51 carried by lug **48*c* of tumbler 48, whereas finger 62 is intended to be urged by the thermal bimetallic strip tripping device in the case of an electric overload. In FIG. 1, it can be seen that the three part assembly including hook 31, lever 35, tumbler 48 has a triangular formation capable of being deformed under the action of the bimetallic strip, lever 35 being connected to tumbler 48 through stud 51 and interlocked with hook 31** by means of the pivot pin $A_5$.

The manner of adjusting the thermal tripping current will now be described first of all in the factory then by the user, using the above described device, with reference to FIGS. 5 to 8.

Factory adjustment

In a first initial step, wheel 32 is positioned so that its graduation corresponding to the minimum value of the thermal current is opposite the index carried by the case, as illustrated in FIG. 4. Wheel 32 is then locked or immobilized in this position, with respect to the case, by means for example of a pin (not shown).

With the wheel in the locked position, the arm 37 (FIG. 3) of the flange carrying the finger meshing with the teeth of the wheel has sufficient elasticity to allow the flange to be rotated.

Figure 5:
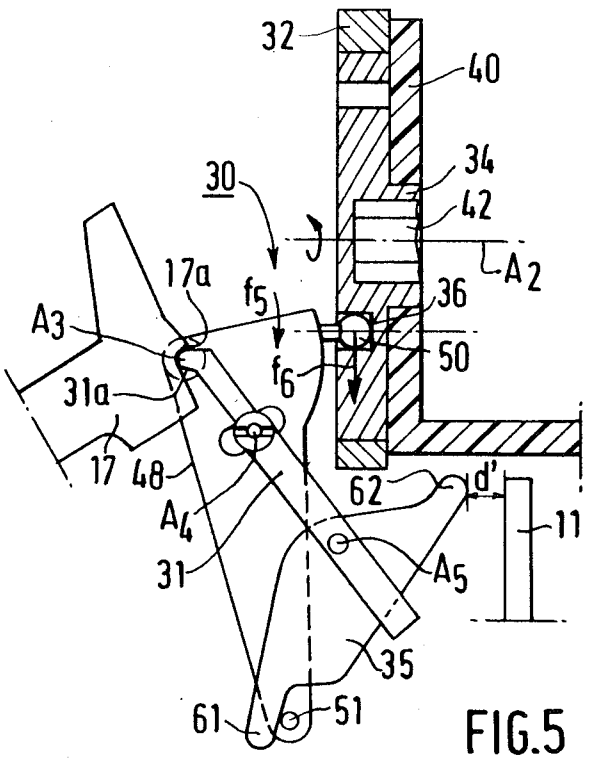

After locking the wheel, the circuit breaker is placed in the set position in which head **31*a* of hook 31 comes to bear, under the action of a spring (not shown), against the nose 17*a* of the tripping piece 17, as can be seen in FIG. 5. In this position illustrated in FIG. 5, the center of the rounded head 31*a* of the hook is placed by construction on the axis of rotation $A_3$ of the tumbler 48; as for lever 35, its finger 61 engages with the stud 51 of the tumbler, whereas its other finger 62 is situated at a distance d′ from the bimetallic strip 11**.

Figure 6:
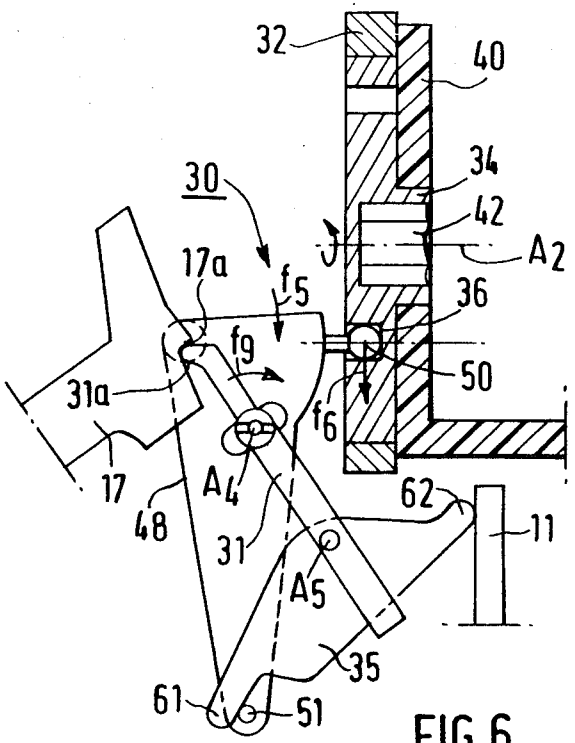
FIGS. 5 to 8 show, in elevation, the adjustment device respectively in different positions taken during adjustment, with certain components of the circuit breaker omitted.

In a second step, with the wheel still in the locked position, flange 34 is rotated in the suitable direction about its axis $A_2$ (FIG. 5), by means of a tool introduced into the blind hole 42, so as to rotate the tumbler 48 in the clockwise direction as shown by arrow $f_5$ in FIG. 5. For this, during rotation of the flange, the drive finger 50 engaged in the excentric groove 36 of the flange moves downwards as shown by arrow $f_6$ in FIG. 5. During rotation of tumbler 48, stud 51 carried by the tumbler then drives lever 35 in a clockwise direction which pivots about $A_5$ so as to come into contact, by its finger 62, against the bimetallic strip 11, as shown in FIG. 6.

Figure 7:
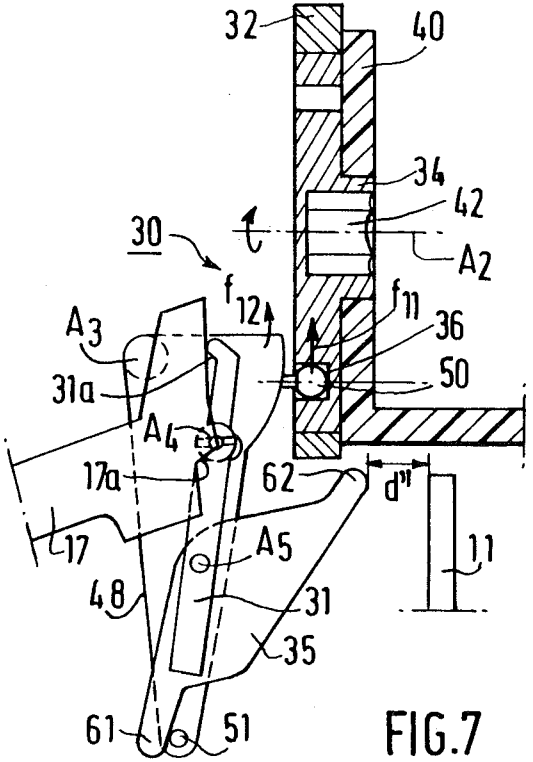

From this position of lever 35 bearing against the bimetallic strip 11 (FIG. 6), a further rotation of the tumbler 48 in the clockwise direction (arrow $f_5$) causes breakage of the link formed by hook 31 and lever 35; hook 31 pivots in a clockwise direction (arrow $f_9$) about its pin $A_4$ and is released, at the level of its head **31*a*, from the nose 17*a* of the tripping piece 17. In FIG. 7 the position has been shown which is occupied by lever 35 and hook 31 once released from piece 17**.

As soon as hook 31 is released from piece 17 (FIG. 7), this latter then causes tripping of the circuit breaker under the action of the lock; finger 62 of lever 35 is then situated at a distance d″ from the bimetallic strip 11 (FIG. 7).

At this step, the position of flange 34 which has just caused tripping of the circuit breaker (FIG. 7) forms a so called zero reference position for adjustment of the bimetallic strip in the factory.

Thus, in a third step, with the wheel still in the locked position and starting from said previously obtained zero reference position, flange 34 is rotated in the reverse direction (FIG. 7) through a predetermined angle so as to move finger 62 of lever 35 over a predefined distance equal to the stroke of the bimetallic strip for the graduation corresponding to the minimum value of the thermal current and initially placed opposite the index of the case when the wheel was locked.

It will be noted that the predetermined angle may be replaced by counting a predetermined number of teeth which the meshing finger of the flange jumps over.

In greater detail, during rotation in the reverse direction of the flange through the predetermined angle, finger 50 moves upwardly in the direction shown by arrow $f_{11}$ in FIG. 7 and rotates tumbler 48 about its axis $A_3$ in an anticlockwise direction as shown by arrow $f_{12}$ (FIG. 7); lever 35 bearing against stud 51 of the tumbler also pivots in an anticlockwise direction so as to move further away from the bimetallic strip.

Figure 8:
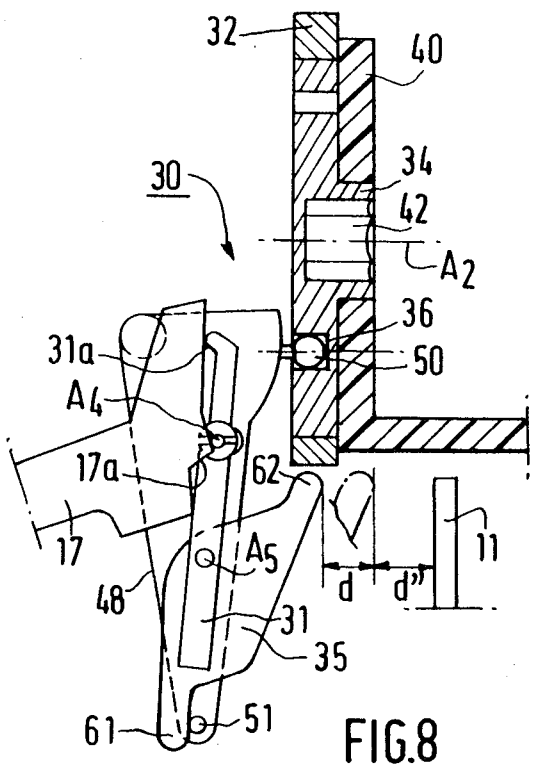

In FIG. 8 the final position has been shown taken by finger 62 of lever 35 which has moved over a predefined disatnce d with respect to its preceding so called zero reference position partially illustrated with broken lines in this FIG. 8. This distance d corresponds then to the stroke of the bimetallic strip for the minimum value of the thermal current which will cause tripping of the circuit breaker should an electric overload occur. At this step, the factory adjustment is finished; wheel 32 is then released and interlocked with flange 34 throgh the meshing finger 38 (FIG. 3).

User adjustment

On the wheel is provided a graduated scale of direct or relative values of the thermal current, which the user may bring successively opposite the index carried by the case by rotating the wheel.

On the other hand, since the value of the stroke of the bimetallic strip as a function of each value of the thermal current is known, the graduations are spaced over the wheel so that, by turning the wheel to pass from one graduation to another, the lever moves by a corresponding known value.

With the wheel henceforth in the released position, the arm of the flange carrying the finger meshing with the teeth of the wheel has sufficient stiffness to allow the flange to be driven in rotation with the wheel when this latter is rotated.

Under these conditions, depending on the chosen value of the thermal current, rotation of the wheel effected manually by the user so as to bring the graduation corresponding to this current value opposite the index carried by the case, causes, through the tumbler 48 driven by finger 50, a movement of finger 62 of lever 35 over a distance corresponding, with respect to the zero reference, to the stroke of the bimetallic strip for this chosen value of the thermal tripping current.

Figure 9:
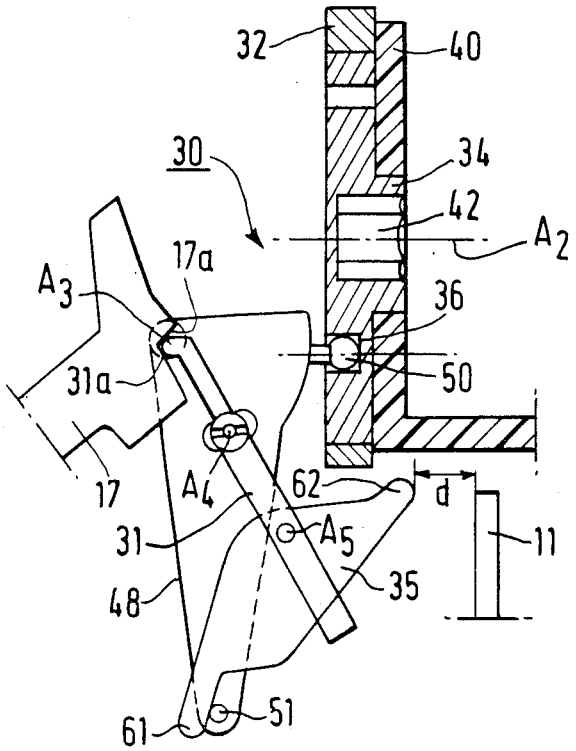
FIG. 9 shows, in elevation, the adjustment device associated with the circuit breaker in the set position such as shown in FIG. 1, after adjustment of the thermal current and with omission of certain components of the circuit breaker.

In FIG. 9, the position of finger 62 of lever 35 with respect to the bimetallic strip 11 has been shown for the minimum thermal current value chosen by the user, the circuit breaker being replaced in its set position such as shown in FIG. 1; of course, this particular choice of the thermal current value is given solely by way of illustration and is in no wise limitative.

Thus, during setting of the circuit breaker (FIG. 9), hook 31 takes up its position in abutment against the nose of the tripping piece 17, whereas the finger 62 of lever 35 pivoting on the hook is henceforth situated at the distance d from the bimetallic strip 11. This distance d is therefore equal to the stroke of the bimetallic strip for the minimum value of the thermal current chosen by the user, in this example.

Should an electric overload occur, the circuit breaker passes from its set position (FIG. 9) to its tripped position through action of the bimetallic strip, in accordance with the same procedure described above with reference to FIGS. 1 and 2.

What is claimed is:

1. A device for adjusting the tripping current of a thermal bimetallic strip tripping unit having a tripping piece housed in a case, said device including in the case:

a wheel accessible from outside the case and having inner toothing, the wheel carrying graduations which correspond to direct or relative tripping current values and which may be brought, by rotating said wheel, opposite an index carried by the case;

an inner flange centered on the wheel, adapted to be driven in rotation, having a member meshing with the teeth of the wheel, and formed with a groove of excentric shape with respect to the axis of rotation of the wheel;

a piece forming a tumbler rotatable about an axis perpendicular to the axis of rotation of the wheel through a drive member engaged in the groove of the flange, the axis of rotation of the tumbler being fixed with respect to the case.

a hook mounted for pivoting about an axis parallel to the axis of rotation of the tumbler and capable of cooperating with said tripping piece;

said device further including a lever which is pivotally mounted in its median part on the hook by means of a pin so as to form a broken link therewith, and which cooperates at one end with the tumbler through a connection piece, the lever having a second free end intended to be situated with respect to the thermal bimetallic strip tripping unit at a distance depending on the chosen value of the tripping current.

2. The device as claimed in claim 1, wherein said tumbler has substantially the shape of a U in which the external face of the bottom carries the drive member engaged in the groove of the flange, and one of the two side walls of which is extended by a vertical lug, said connecting piece including a stud carried by the lug near its free end, and the two ends of said lever being formed respectively by two fingers one of which rests in abutment on the stud and the other of which is intended to cooperate with the thermal bimetallic strip tripping unit, the two fingers extending in a direction transversal to the pivoting axis of the lever with the hook and being situated on each side of this axis.

3. The device as claimed in claim 2, wherein the two side walls of the U shaped tumbler are pierced respectively with two coaxial orifices allowing the free passage of two transverse coaxially aligned swivels between which the hook is suspended, said swivels being mounted for pivoting on a shaft which is fixed with respect to the case and their axis defining the pivoting axis of the hook.

4. A protection switch including in an isolating case:

a switchable current path in which is disposed at least one pair of cooperating contacts;

lock means having a latched position in which it maintains the contacts in closed position and an unlatched position in which the contacts open;

a thermal bimetallic strip tripping unit and unlatching and adjusting means including:

i- a wheel accessible from outside the case and having inner toothing, the wheel carrying graduations which correspond to direct or relative tripping current values and which may be brought, by rotating said wheel, opposite an index carried by the case;

ii- an inner flange centered on the wheel, adapted to be driven in rotation, having a member meshing with the teeth of the wheel, and formed with a groove of excentric shape with respect to the axis of rotation of the wheel;

iii- a piece forming a tumbler rotatable about an axis perpendicular to the axis of rotation of the wheel through a drive member engaged in the groove of the flange, the axis of rotation of the tumbler being fixed with respect to the case;

iv- a hook mounted for pivoting about an axis parallel to the axis of rotation of the tumbler and cooperating said lock means to trigger said lock means into said unlatched position;

v- a lever which is pivotally mounted in its median part on the hook by means of a pin so as to form a broken link therewith, and which cooperates at one end with the tumbler through a connection piece, the lever having a second free end intended to be situated with respect to the thermal bimetallic strip tripping unit at a distance depending on the chosen value of the tripping current.

* * * * *